United States Patent [19]

Nederman

[11] 4,224,960

[45] Sep. 30, 1980

[54] WIND-UP DEVICE FOR FLEXIBLE CONDUITS, SUCH AS HYDRAULIC HOSES

[76] Inventor: Bill P. P. Nederman, Halalid 3, 252 33 Helsingborg, Sweden

[21] Appl. No.: 939,690

[22] Filed: Sep. 5, 1978

[30] Foreign Application Priority Data

Sep. 8, 1977 [SE] Sweden ..... 7710080

[51] Int. Cl.[3] ..... B65H 75/48

[52] U.S. Cl. ..... 137/355.23; 242/107; 137/355.26

[58] Field of Search ..... 137/355.16, 355.17, 137/355.2, 355.23, 355.26; 242/107, 107.5

[56] References Cited

U.S. PATENT DOCUMENTS

| | | | |
|---|---|---|---|
| 2,340,630 | 2/1944 | Ungar | 137/355.19 |
| 2,887,121 | 5/1959 | Magee | 137/355.23 |
| 3,467,134 | 9/1969 | Becker et al. | 137/355.19 |
| 3,552,425 | 1/1971 | Olson | 137/355.17 |
| 3,709,252 | 1/1973 | Bishop | 137/355.17 |

FOREIGN PATENT DOCUMENTS 1378032 12/1974 United Kingdom .

*Primary Examiner*—Martin P. Schwadron
*Assistant Examiner*—A. Michael Chambers
*Attorney, Agent, or Firm*—Schwartz, Jeffery, Schwaab, Mack, Blumenthal & Koch

[57] ABSTRACT

A wind-up device for a flexible conduit, such as a hydraulic hose. The wind-up device includes a drum rotatable on a stationary shaft. A coil spring assembly including a spiral coil spring therewithin is mounted at one end of the shaft and the outer axial end of the drum. The other, opposite end of the shaft includes a fixation portion by which the shaft is fixed in its stationary condition. The radially inner end of the coil spring is anchored with respect to the stationary shaft through a spring hub detachably mounted to the one end of the shaft. The spring hub serves not only to anchor the spring with respect to the shaft but also to provide an axial pressure bearing at the one end of the shaft for holding the drum in place axially on the shaft. One or more fixation elements extend between the spring hub and the shaft to normally prevent relative rotation between the spring hub and shaft. At least one of these fixation elements is eccentrically positioned. Such fixation element is movable out of engagement with the shaft to selectively permit relative rotation between the spring hub and the shaft to effect tensioning or release of the coil spring.

4 Claims, 3 Drawing Figures

WIND-UP DEVICE FOR FLEXIBLE CONDUITS, SUCH AS HYDRAULIC HOSES

The present invention relates to a device for winding up flexible conduits, such as hydraulic hoses, said device comprising at least one wind-up drum having a hub which is rotatably mounted on a shaft, at least one flexible conduit adpated to be wound up on said wind-up drum being connected to at least one connector extending through said hub and shaft and opening into a fixation-end portion of said shaft, and at least one coil-spring means is so connected with the shaft and with the wind-up drum as to cause at least one coil-spring forming part of said coil-spring means to become tensioned when, upon unwinding the conduit from the wind-up drum, the wind-up drum is rotated relative to the shaft.

In wind-up devices of the above-stated type, the coil-spring means should be capable of rapid replacement without releasing portions of the system, for instance so that a vacuum pressure therein will be disturbed or so that any liquid contained therein will be spilled out. However, in previosly known constructions it is impossible to carry out a rapid replacement of the coil-spring means because such a replacement involves extensive labour, for instance disassembly of the wind-up drum from its shaft, releasing sealing elements and components forming part of the system, accompanied by the risk, on one hand of damage to the sealing elements and, on the other hand, of disturbing any vacuum pressure, and further of spillage of, for instance, oil contained in the system.

The object of the present invention is to eliminat these drawbacks and, in the arrangement stated in the opening paragraph, to make provisions for enabling, with simple means, a rapid replacement of the coil-spring means without any need of releasing internal parts of the construction. This, according to the invention, is enabled substantially by the fact that the coil-spring means is detachably mounted on an outer end-portion of the shaft opposite to its fixation-end portion and at the end of the wind-up drum remote from the fixation-end portion of the shaft.

The invention will be described more in detail hereinafter with reference to the accompanying drawings, in which.

Figure 1:
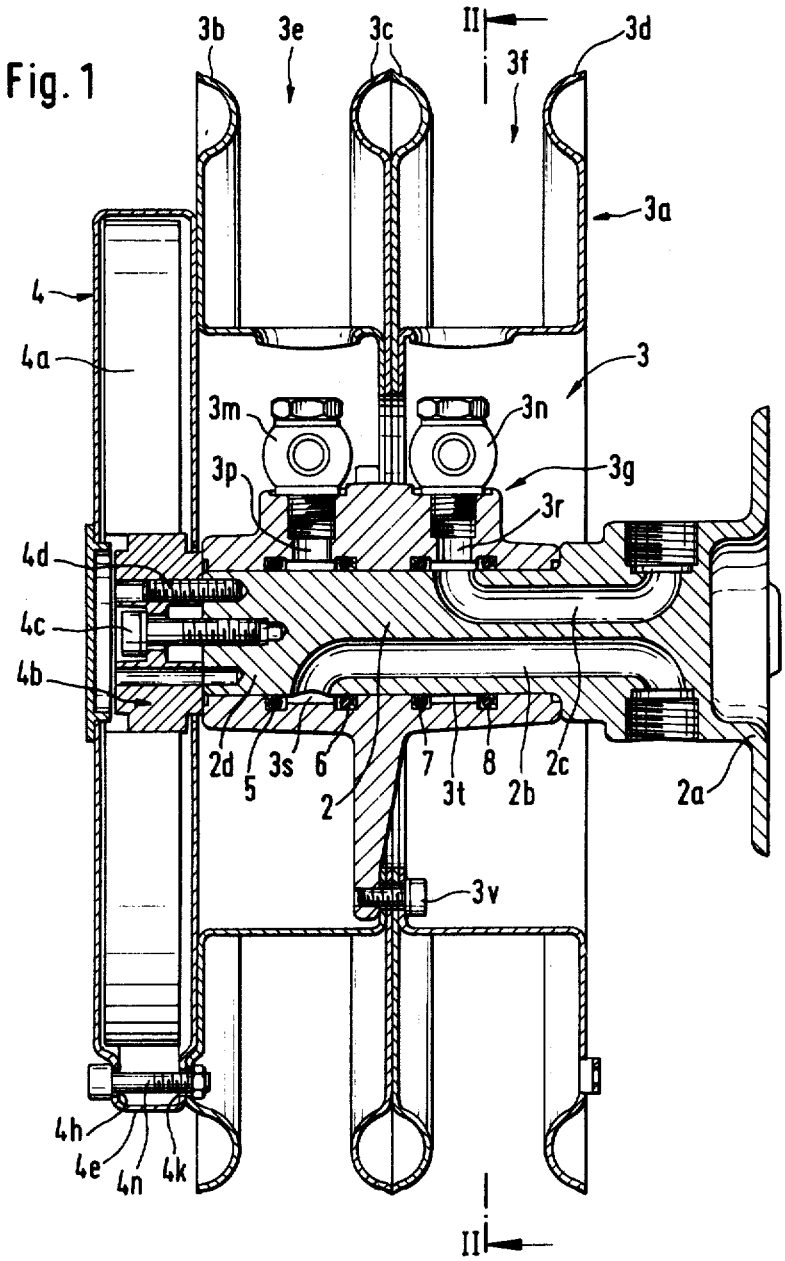
FIG. 1 is a cross-section view illustrating a wind-up device according to the invention.
Figure 2:
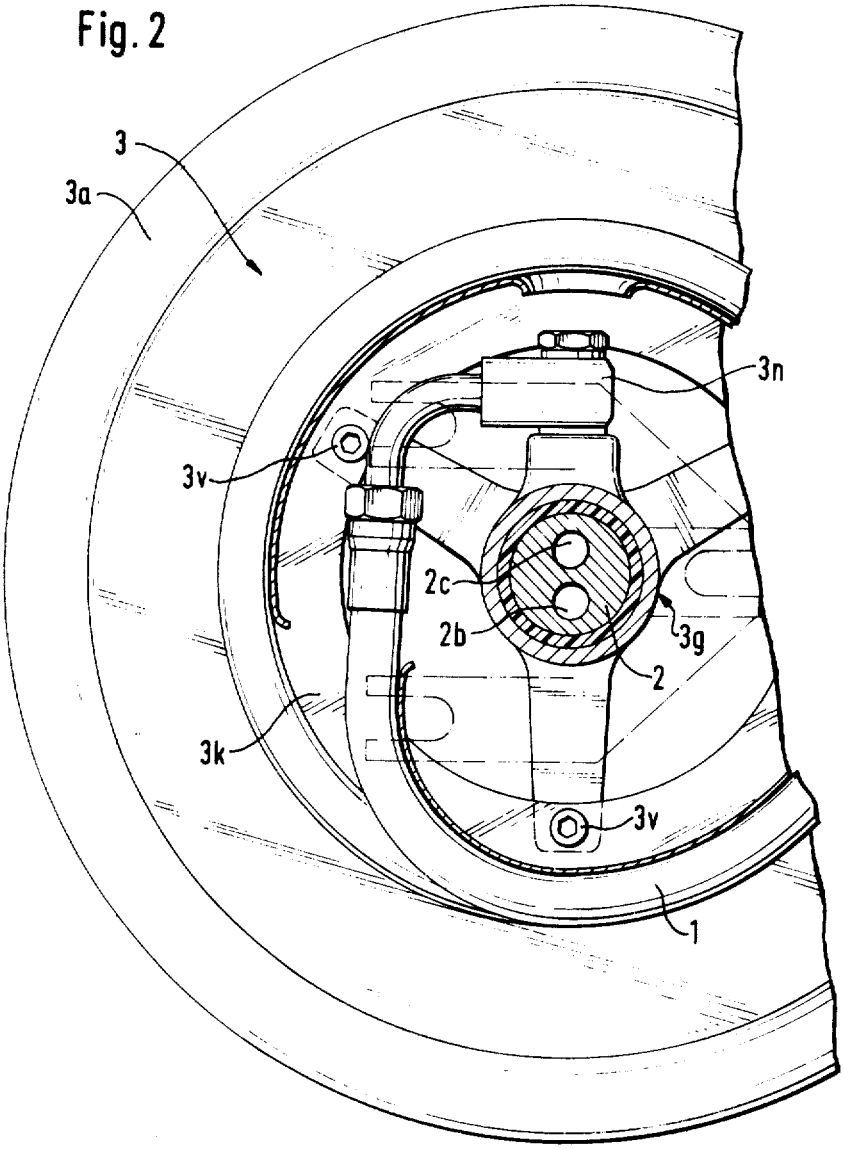
FIG. 2 is a cross-section view of the wind-up device and taken along lines II—II in FIG. 1.

The wind-up devices illustrated in the drawings by way of example only are intended for winding up flexible liquid conduits, or hoses, 1. The wind-up devices comprise a shaft 2, one end of which constitutes a fixation-end portion 2*a* which is adapted to be secured to a fixed carrier member or the like (not shown). The fixation parts forming part of the fixation-end portion 2*a* are previously known, per se, and thence, need neither be shown, nor described more closely.

Rotatably mounted on shaft 2 is a wind-up drum 3 commprising an outer portion 3*a* consisting of three wall elements 3*b*, 3*c* and 3*d* defining together two circular spaces 3*e*, 3*f* for accommodating the flexible hydraulic conduit, or hose, 1. The outer portion 3*a* is attached to a housing which is rotatably mounted on the shaft 2. The hydraulic conduit or hose 1 passes to the hub 2 through openings 3*k* in the outer portion and is connected to connectors so as to communicate with flow connections in the form of passageways 3*p*, 3*r* in the hub and 2*b*, 2*c* in the shaft 2. The passageways 2*b*, 2*c* extend through shaft 2 towards the fixation-end portion 2*a*, where they are terminated in such a way as to be able to communicate with flexible conduits or hoses (not shown) connected to the shaft 2.

Figure 3:
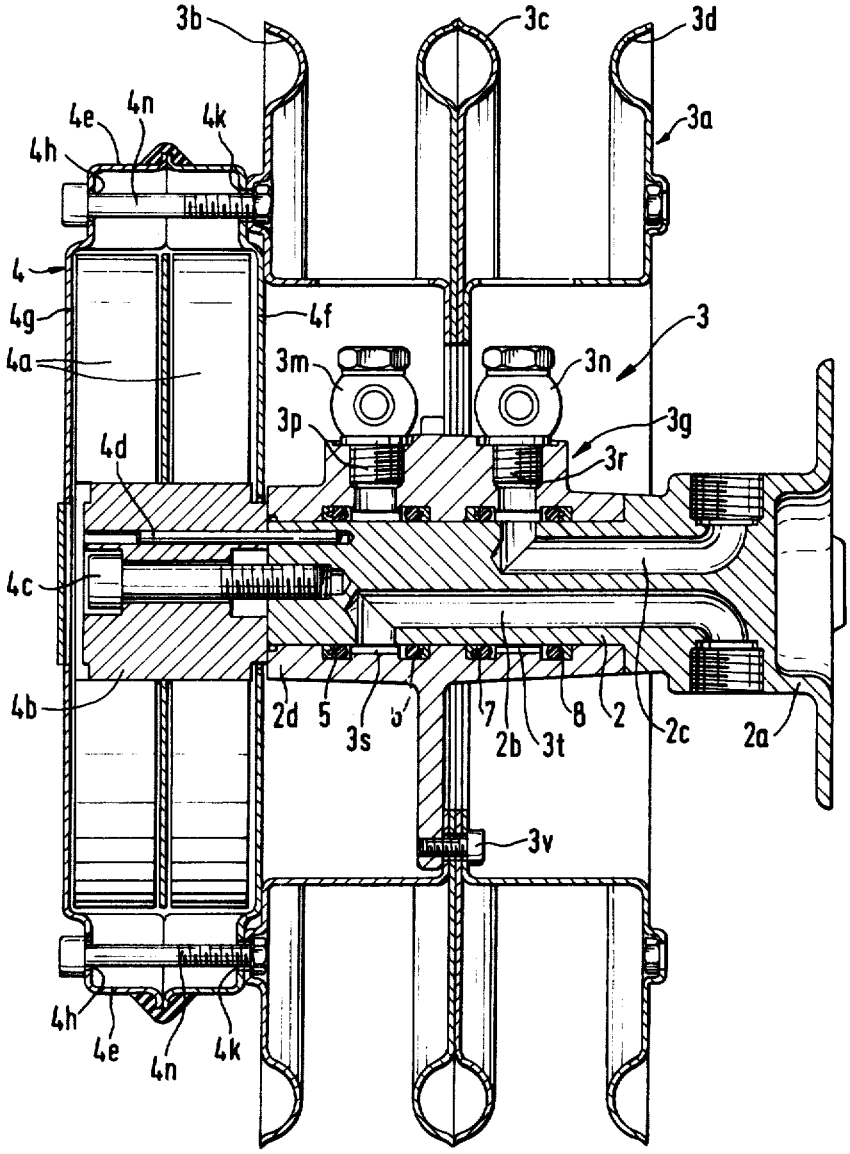
FIG. 3 is a cross-section view illustrating an alternative embodiment of the inventive wind-up device.

The wind-up devices illustrated further comprise a coil-spring assembly 4 including a coil-spring 4*a* (or two coil-springs, as shown in FIG. 3) which has its inner end connected to the stationary shaft 2 and its outer end to the wind-up drum 3, whereby it will be tensioned when the wind-up drum 3 is rotated by the unwinding motion of the hydraulic conduit 1, thereby tending to pull back the unwinded portion of the hydraulic flexible conduit.

To enable the coil-spring assembly 4 to be replaced rapidly and without any need of uncovering or exposing the passageways 3*p*, 3*r* and 2*b*, 2*c*, this spring assembly is detachably mounted on an outer end portion 2*d* of the shaft 2 opposite to its fixation-end portion 2*a* and at the end 3*b* of the wind-up drum 3 remote from the fixation-end portion 2*a*.

The coil-spring assembly 4 preferably comprises a spring hub 4*b* detachably mounted on the outer end portion 2*d* of the shaft, this hub serving, on one hand, as an anchorage element for one or more of the springs 4*a* of the coil-spring assembly 4, and, on the other hand, as an axial pressure bearing holding the hub 3*g* of the wind-up drum 3 in place on the shaft 2.

The spring hub 4*b* is suitably secured to the shaft 2 by a center-screw 4*c* and at least one fixation element 4*d* (such as a set screw, for example) which is located in an eccentric position and adapted normally to prevent any rotation of the spring hub 4*b* relative to the shaft 2. By removing the fixation element 4*d* and releasing the center screw 4*c*, the spring hub 4*b* can be rotated relative to the shaft 2, thereby tensioning or releasing the coil-spring 4.

To obviate the need of providing different springs for enabling winding-up in either sense, the coil-spring 4 is provided with dual brackets 4*e* which enables the same to be connected to the wind-up drum 3 with either end, 4*f* or 4*g* disposed next to the wind-up drum. Each bracket 4*e* suitably comprises, on one hand, apertures 4*h*, 4*k* made in a symmetrically projecting portion 41 of a casing 4*m* forming part of the coil-spring assembly 4, and, on the other hand, through-bolts 4*n* passing throug said projecting portion 41 and the apertures 4*h*, 4*k*.

Since, when the coil-spring assembly 4 is to be replaced, dissassembly of the wind-up drum 3 from the shaft 2 need not be undertaken, the sealing arrangement for sealing the passageways 2*b*, 3*p* and 2*c*, 3*r* may comprise sealing rings 5, 6, 7 and 8 disposed in annular grooves 3*s*, 3*t* formed in the hub 3*g*.

Details less essential for the invention and previously known have been omitted from description. It may be mentioned, however, that the enclosure of the coil-spring assembly 4 is suitably perfectly symmetrical, and that the extreme end of the coil spring is connected to said enclosure in a manner known per se. The end portion 3*a* of the wind-up device 3 may be detachably secured to the hub 3*g*, such as by screws 3*v*. The wind-up device, of course, is applicable for use with other types of flexible conduits than hydraulic hoses, such as for flexible conduits for other liquids or for gases or for electric cables etc. In other words, the embodiment here described is merely illustrative of the invention without limitation otherwise than as defined by the features disclosed in the appended claims.

I claim:

1. A wind-up device for a flexible conduit, the device comprising:

(a) a wind-up drum on which the flexible conduit is to be wound, said drum including a central drum hub, inner and outer axial ends and inner and outer end walls corresponding, respectively, to said inner and outer axial ends;

(b) a stationary shaft on which said drum hub is rotatably mounted, said shaft having first and second ends, said drum and drum hub being generally disposed between first and second ends so that said outer end of said drum is disposed adjacent said first end of said shaft and said inner end of said drum faces toward said second end of said shaft;

(c) means for fixing said shaft in its stationary condition, said fixing means including a fixation portion of said shaft at said second end of said shaft;

(d) a conduit connection for the flexible conduit, said conduit connection extending from said fixation portion of said shaft, through said shaft and said drum hub, to said drum;

(e) a coil spring assembly including a coil spring having radially inner and outer ends, said coil spring assembly being coupled with said shaft and said drum, whereby said coil spring becomes tensioned when said drum is rotated relative to said shaft upon the unwinding of the flexible conduit from the drum;

(f) said coil spring assembly being detachably mounted to both:

(i) said first end of said shaft; and (ii) said outer end of said drum;

(g) said coil spring assembly including a spring hub detachably mounted to said first end of said shaft;

(h) means for anchoring the radially inner end of said coil spring with respect to said shaft;

(i) axial pressure bearing means at said first end of said shaft for holding said drum hub in place axially on said shaft;

(j) said spring hub constituting both said anchoring means and said axial pressure bearing means;

(k) means for securing said spring hub to said shaft to normally prevent relative rotation between said shaft and spring hub, said securing means including a fixation element extending from said spring hub into engagement with said shaft, said fixation element being located in an eccentric position with respect to said spring hub and said shaft, said fixation element being movable out of engagement with said shaft to selectively permit relative rotation between said spring hub and said shaft to effect tensioning or release of said coil spring.

2. A wind-up device as defined in claim 1 wherein said coil spring assembly includes a pair of oppositely facing axial ends, one of which is connected to said drum, said coil spring assembly also including means for enabling either one of said oppositely facing ends to be connected with said drum, said enabling means including brackets in said coil spring assembly.

3. A wind-up device as defined in claim 2 wherein said coil spring assembly includes a casing in which said coil spring is disposed, said brackets comprising symmetrically projecting portions of said casing having holes therein and bolts which pass through said holes.

4. A wind-up device as defined in claims 1, 2 or 3 including sealing elements disposed between said drum hub and said shaft and wherein said conduit connection comprises a passageway in said drum hub and a passageway in said shaft, said passageways communicating with each other and being sealed by said sealing elements, said drum hub including grooves therein, said sealing elements including sealing rings disposed in said grooves on respective sides of said drum hub passageway and said shaft passageway.

* * * * *